US009568213B2

(12) United States Patent
Qiu et al.

(10) Patent No.: US 9,568,213 B2
(45) Date of Patent: Feb. 14, 2017

(54) STOREAGE GAS WATER HEATER

(75) Inventors: Bu Qiu, Nanjing (CN); Dayan Bi, Nanjing (CN); Liliang Dou, Nanjing (CN); Xiangcai Zeng, Nanjing (CN); Chaojun Yang, Nanjing (CN)

(73) Assignee: A. O. SMITH CORPORATION, Milwaukee, WI (US)

( * ) Notice: Subject to any disclaimer, the term of this patent is extended or adjusted under 35 U.S.C. 154(b) by 948 days.

(21) Appl. No.: 13/378,706

(22) PCT Filed: Jun. 15, 2010

(86) PCT No.: PCT/US2010/038620
§ 371 (c)(1),
(2), (4) Date: Dec. 16, 2011

(87) PCT Pub. No.: WO2010/147948
PCT Pub. Date: Dec. 23, 2010

(65) Prior Publication Data

US 2012/0090562 A1 Apr. 19, 2012

(30) Foreign Application Priority Data

Jun. 16, 2009 (CN) ..... 2009 1 0033216

(51) Int. Cl.
*F24H 1/20* (2006.01)
*F23D 14/00* (2006.01)
(Continued)

(52) U.S. Cl.
CPC ..... *F24H 1/28* (2013.01); *F23C 3/002* (2013.01); *F23C 3/004* (2013.01); *F24H 1/0036* (2013.01); *F24H 1/205* (2013.01); *F24H 1/206* (2013.01)

(58) Field of Classification Search
None
See application file for complete search history.

(56) References Cited

U.S. PATENT DOCUMENTS 2,825,226 A * 3/1958 Daley, Jr. ..... G01N 25/32 236/15 E
3,695,250 A * 10/1972 Rohrs ..... F28D 19/04 126/110 R
(Continued)

FOREIGN PATENT DOCUMENTS

CN 2172433 7/1994
CN 2294427 10/1998
(Continued)

OTHER PUBLICATIONS

PCT/US2010/038620 International Search Report and Written Opinion dated Dec. 20, 2012 (14 pages).
(Continued)

*Primary Examiner* — Gregory Huson
*Assistant Examiner* — Eric Gorman
(74) *Attorney, Agent, or Firm* — Michael Best & Friedrich LLP

(57) ABSTRACT

A gas water heater includes a water tank, a combustion chamber, a burner, a heat exchanger tube at least partially within the water tank, and a fan. The burner receives fuel gas and primary air from a first air-supply channel to create a primary air-fuel mixture for combustion in the combustion chamber with secondary air. The primary air-fuel mixture has a gas concentration above the upper explosive limit of the fuel gas. Secondary air is supplied through a second air-supply channel to the combustion chamber. The secondary air creates a low excess air ratio (e.g., below 1.5) for combustion in the combustion chamber. A totally sealed channel is defined from the air inlet of the fan to the heat exchanger tube.

12 Claims, 9 Drawing Sheets

(51) Int. Cl.

| | |
|---|---|
| ***F24H 1/00*** | (2006.01) |
| ***F23C 3/00*** | (2006.01) |
| ***F24H 1/28*** | (2006.01) |

(56) References Cited

U.S. PATENT DOCUMENTS

| | | | | |
|---|---|---|---|---|
| 4,318,392 | A * | 3/1982 | Schreiber et al. | 126/110 R |
| 4,358,265 | A * | 11/1982 | Tanaka et al. | 431/76 |
| 4,403,572 | A * | 9/1983 | Gerstmann et al. | 122/20 B |
| 4,502,626 | A * | 3/1985 | Gerstmann et al. | 122/44.2 |
| 4,641,631 | A | 2/1987 | Jatana | |
| 4,752,213 | A | 6/1988 | Grochowski et al. | |
| 4,884,555 | A * | 12/1989 | Huang | 122/17.1 |
| 4,951,651 | A * | 8/1990 | Shellenberger | 126/116 R |
| 5,022,352 | A | 6/1991 | Osborne et al. | |
| 5,171,144 | A * | 12/1992 | Gerstmann et al. | 431/159 |
| 5,333,574 | A * | 8/1994 | Brady et al. | 122/367.1 |
| 5,359,989 | A * | 11/1994 | Chase et al. | 126/110 R |
| 5,417,199 | A * | 5/1995 | Jamieson et al. | 126/110 AA |
| 5,516,278 | A * | 5/1996 | Morrison | 431/171 |
| 5,525,054 | A | 6/1996 | Nakaura et al. | |
| 5,636,598 | A * | 6/1997 | Moore, Jr. | 122/18.3 |
| 6,036,480 | A * | 3/2000 | Hughes et al. | 431/353 |
| 6,085,701 | A * | 7/2000 | Stauffer et al. | 122/367.1 |
| 6,267,586 | B1 | 7/2001 | Maricic | |
| 6,470,836 | B1 * | 10/2002 | Manley et al. | 122/40 |
| 6,625,971 | B2 * | 9/2003 | Graves | 60/776 |
| 6,948,455 | B2 * | 9/2005 | Ferguson et al. | 122/367.3 |
| 2002/0148415 | A1 * | 10/2002 | Manley et al. | 122/40 |
| 2004/0072110 | A1 * | 4/2004 | Kayahara et al. | 431/5 |
| 2004/0106079 | A1 * | 6/2004 | Kayahara et al. | 431/115 |
| 2006/0150925 | A1 | 7/2006 | Akkala et al. | |
| 2007/0000453 | A1 * | 1/2007 | King et al. | 122/31.1 |
| 2007/0051358 | A1 * | 3/2007 | Missoum et al. | 126/110 R |
| 2007/0099134 | A1 * | 5/2007 | Hamada et al. | 431/12 |
| 2007/0125318 | A1 | 6/2007 | Hubbard et al. | |
| 2007/0209606 | A1 * | 9/2007 | Hamada et al. | 122/18.1 |
| 2008/0006226 | A1 * | 1/2008 | Takeda et al. | 122/18.1 |
| 2008/0066694 | A1 * | 3/2008 | Smith et al. | 122/18.1 |
| 2010/0043728 | A1 * | 2/2010 | Ma et al. | 122/18.3 |
| 2010/0111508 | A1 * | 5/2010 | Ding et al. | 392/308 |
| 2012/0037096 | A1 * | 2/2012 | Watanabe | F23L 11/02 122/14.21 |
| 2013/0112155 | A1 * | 5/2013 | Abdel-Rehim et al. | 122/15.1 |
| 2013/0247844 | A1 * | 9/2013 | Cheng | F23D 14/045 122/18.4 |
| 2014/0020669 | A1 * | 1/2014 | Sherrow et al. | 126/110 C |
| 2015/0338127 | A1 * | 11/2015 | Kim | F23L 15/00 122/18.4 |
| 2015/0369495 | A1 * | 12/2015 | Maricic | F23D 14/045 126/116 A |

FOREIGN PATENT DOCUMENTS

| | | |
|---|---|---|
| CN | 1584437 | 2/2005 |
| CN | 201032250 | 3/2008 |
| CN | 201037694 | 3/2008 |
| CN | 201069249 | 6/2008 |
| DE | 8813583 | 12/1988 |
| EP | 0109002 | 5/1984 |
| JP | H01144616 | 6/1989 |
| JP | H0364314 | 3/1991 |
| JP | 2003/021323 | 1/2003 |
| JP | 2008025985 | 2/2008 |
| WO | 2008/088198 | 7/2008 |

OTHER PUBLICATIONS

EP10724678.7 Extended European Search Report dated Jan. 22, 2016 (7 pages).

Office Action from the Canadian Intellectual Property Office for Application No. 2765690 dated Apr. 19, 2016 (4 pages).

* cited by examiner

STOREAGE GAS WATER HEATER

CLAIM OF PRIORITY

This application claims priority to Chinese Patent Application No. 200910033216.7 filed Jun. 16, 2009.

BACKGROUND

The present gas water heater may be classified as a storage gas water heater and a tankless gas water heater based on the hot water demand characteristics.

SUMMARY

A tankless gas water heater is sometimes also referred to as an instant available water heater, and is common in Japan and more recently in China. The combustion system of the common products in the market is a sealed partial premix combustion system and the input power may be up to 32 kw (109,262 BTU/hr). FIGS. 1*a* and 1*b* (collectively, "FIG. 1") illustrate a typical construction for a tankless gas water heater. In FIG. 1, a tankless gas water heater 10 includes a primary air-supply channel 15, a secondary air-supply channel 20, a heat exchanger 25, a burner 30, a fan 35, a cold water inlet 40, a gas inlet 45, and a hot water outlet 50. The combustion system is located below the heat exchanger 25 and the flame burns from bottom up. Generally, several harmonica-like burners 30 are used, as shown in FIG. 1*b*. Japanese patents JP 2008-25985, 03-64314 and 01-144616 as well as Chinese patents 200720051450, 20062001192, 9324025 and 97240226 describe tankless water heaters.

A type of heating equipment similar to this is a wall-mounted dual-purpose gas boiler used for domestic hot water supply and heating. The combustion system of such gas boilers is similar to the tankless gas water heater, but some high energy-efficient products of them have adopted a premix combustion system.

The word "sealed" in the term "sealed partial premix combustion system" implies that the flow path from the air inlet of the fan to the flue gas outlet of the water heater is a single channel and that the combustion system has only one air inlet. A traditional non-sealed combustion system places the burner in communication with the atmosphere and generally there is no fan or the fan is at the end of the system. The pressure head is produced by the density difference between cold and hot air or the pumping of the fan, so a negative pressure is formed in the combustion chamber and the air required for combustion is drawn into the combustion chamber naturally. The sealed combustion system is generally in a turbulent combustion condition and the combustion intensity is high, while the non-sealed combustion system creates a laminar combustion condition. So under the same combustion chamber volume and working conditions, the output power of the non-sealed combustion system is less than the sealed combustion system.

Partial premix combustion generally implies that the system divides the combustion air supplied by the fan into two parts, one part entering the burner directly is called primary air, and the other part entering the combustion chamber by the external channel outside the burner is called secondary air. The primary air is evenly mixed with the gas in the burner, which is called premix gas. If the air in the premix gas is not adequate to support complete combustion of the fuel gas, a portion of the fuel gas in the premix gas burns around the outlet of the burner at first which forms the inner flame, and the remaining fuel gas burns with the secondary air by diffusion and forms the outer flame. If the provided secondary air is still not enough to support the complete combustion of the fuel gas in the combustion chamber, it will result in the emission containing contaminants such as CO. One way to control the emission level of the contamination such as CO in a partial premix combustion system is to provide an air volume far more than theoretical value (i.e., well above the stoichiometric ratio), namely the excess air ratio must be much more than 1. In general, the designed excess air ratio is up to 1.8-2.5 (namely 80%-150% more than the theoretical air volume is needed). However, the excess air increases the requirements of the fan, makes the combustion noise higher, and reduces the heat exchange efficiency.

A premix combustion system is generally regarded as a more advanced combustion mode. The premix combustion system fully premixes the fuel gas and the combustion air before the burner and generally controls the excess air ratio between 1.2-1.5. The premix gas burns out immediately after being sprayed from the burner, therefore the burning velocity is high and the contaminant emission level is low. The fuel gas and air mixture in a premix combustion system is close enough to the stoichiometric ratio to permit immediate combustion. As a result, the fan, combustion chamber, and other components must be sealed to comply with typical regulations for the prevention of external flammable vapor ignition. Consequently, premix combustion systems may be more expensive than partial premix combustion systems.

The storage gas water heater is prevalent in the United States of America. In general, the volume of such kind of water heater is above 200 liters (52.83 gallons) in order to satisfy the large quantity of water required, for example, by a bathtub. The storage gas water heater better satisfies the requirements for larger quantities of hot water, but its relatively large volume is less suitable for families with a small living space, so the living conditions of, for example, the Chinese limit its development in China. There are similarly situated families in the United States and other countries who have relatively small living space, and large storage gas water heaters present a similar problem for these families. Thus, how to increase effective hot water supply with reduced water tank volume is an urgent problem to be solved.

The common combustion system used with a storage gas water heater is a premix combustion system or a non-sealed partial premix combustion system. The storage water heater using a premix combustion system has the cost shortcomings set forth above. The storage water heater using a non-sealed partial premix combustion system generally includes a cast iron disk burner, and because of the inherent characteristic of the non-sealed combustion system, the output power of the storage water heater adopting such combustion mode is low, and it may need a relatively long time (more than 1 hour in some instances) to restore hot water following a large draw. To increase the input power of such kind of burner, more combustion air and a bigger combustion chamber are required, but it is challenging or impossible to increase input power beyond certain capacities in view of the natural, atmospheric air supply.

In conclusion, to design a kind of gas water heater combining the advantages of tankless and storage gas water heater is a valuable task to be researched. The Chinese patent with patent number 200720080101 tried to design a gas water heater which not only has the two advantages of tankless gas water heater's "quick and continuous hot water supply" and the storage gas water heater's "constant-temperature hot water supply," but also has greater storage and energy regulating capacity. The Chinese patent with patent number 200410024980 also made some attempt in this field.

However, the two methods are all simple addition of storage water heater and tankless gas water heater and have no breakthrough in technology. The complicated system and big volume is unsuitable to small family customers.

In one embodiment, the invention provides a storage gas water heater including a water tank, a fan, a burner, and a heat exchanger and combustion tube. An air inlet of the fan is open to air outside of the water heater and an outlet of the fan is connected with an air-supply opening. The air-supply opening is connected with the burner by a first air-supply channel and is connected with a combustion chamber of the heat exchanger and combustion tube by a second air-supply channel. The first and second air-supply channels together define a totally-sealed channel from the air inlet of the fan to the heat exchanger and combustion tube. At least part of the heat exchanger and combustion tube is inside the water tank. One end of the heat exchanger and combustion tube is connected with an outlet of the burner and an opposite end is open to air outside of the water heater.

In another embodiment, the invention provides a storage gas water heater including a water tank, a fan, a burner and a heat exchanger and combustion tube. An outlet of the fan is open to air outside of the water heater. An air-supply opening is connected with the burner by a first air-supply channel and is connected with a combustion chamber of the heat exchanger and combustion tube by a second air-supply channel. At least part of the heat exchanger and combustion tube is inside the water tank. One end of the heat exchanger and combustion tube is connected with an outlet of the burner and an opposite end is connected with an air inlet of the fan. The first and second air-supply channels together define a totally-sealed channel from the air-supply opening to the fan outlet.

In another embodiment, the invention provides a gas water heater including a water tank, a combustion chamber, a gas supply conduit, a burner, a heat exchanger tube, and a fan. The water tank is adapted to contain water to be heated. The combustion chamber is positioned at least partially within the water tank and adapted to receive a primary air-fuel mixture and secondary air, and is adapted to contain the complete combustion of the primary air-fuel mixture in the presence of the secondary air for the creation of products of combustion. The gas supply conduit provides fuel gas. The burner includes a burner inlet for the receipt of fuel gas from the gas supply conduit and primary air and a burner outlet communicating with the combustion chamber for delivery of the primary air-fuel mixture to the combustion chamber. The fuel gas and primary air mix in the burner to create the primary air-fuel mixture. The heat exchanger tube is positioned at least partially within the water tank, the heat exchanger tube communicating at a first end with the combustion chamber for the receipt of the products of combustion, the heat exchanger tube transferring heat from the products of combustion to water in the tank, and the heat exchanger tube having a second end for the exhaust of the products of combustion. The fan causes the primary air to flow into the burner, the secondary air to flow into the combustion chamber, and the products of combustion to flow through the heat exchanger tube and out of the second end.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
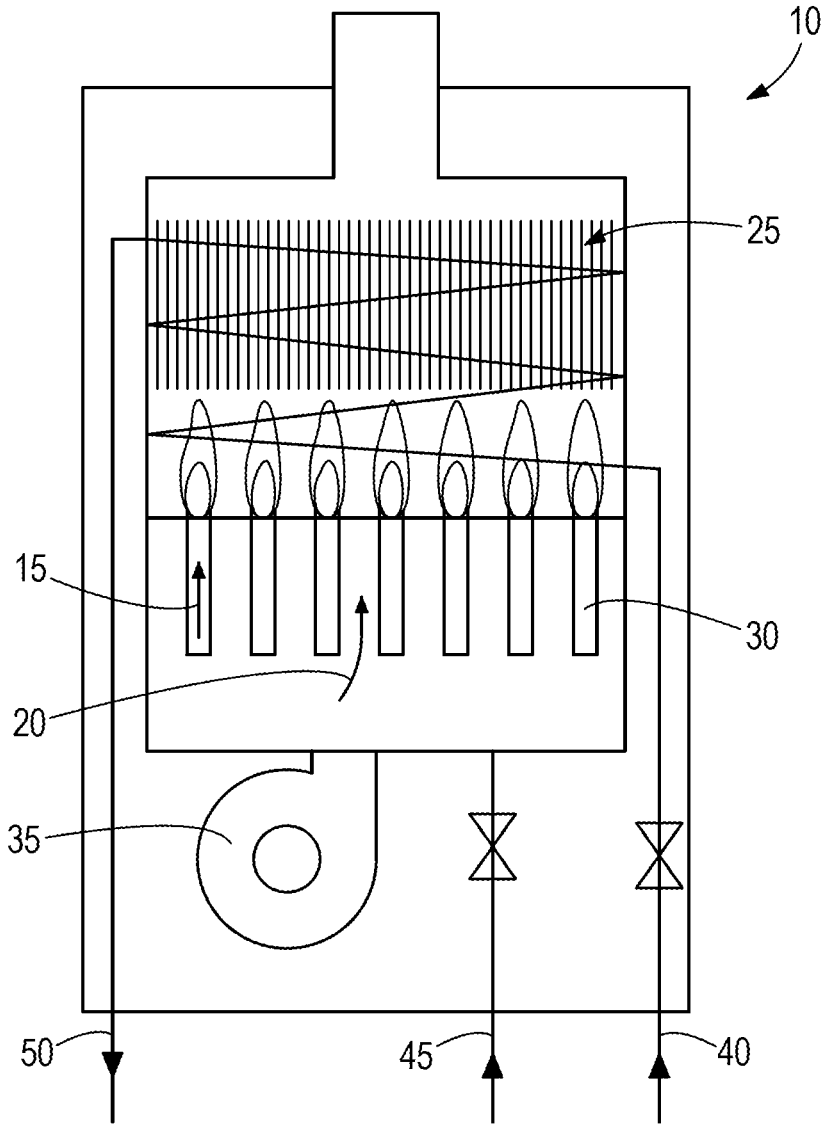
FIG. 1a Prior Art
FIG. 1*a* is a front view of a tankless gas water heater.
Figure 1B:
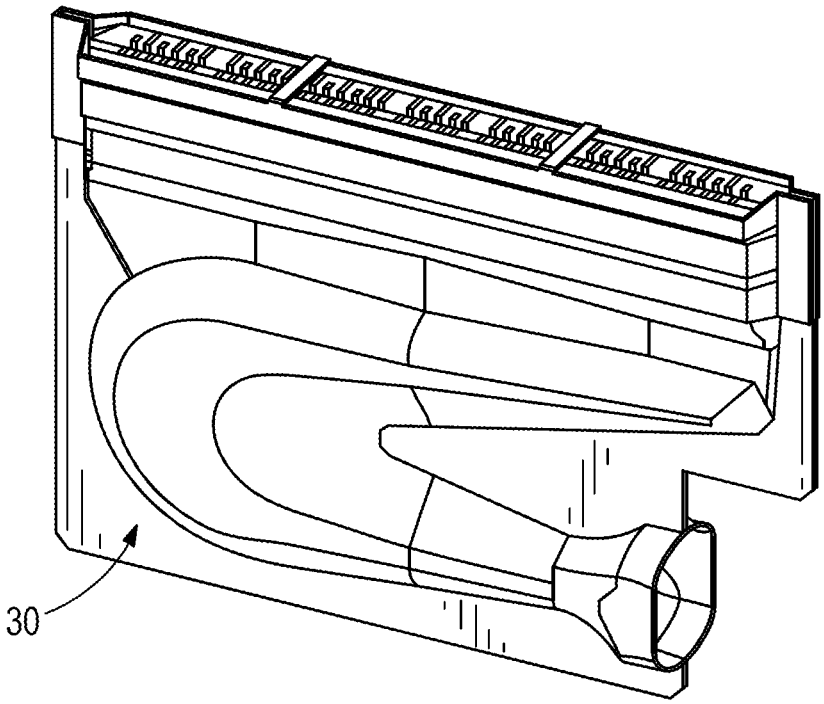
FIG. 1b Prior Art
FIG. 1*b* is a perspective view of a burner used in the tankless gas water heater of FIG. 1*a*.
Figure 2:
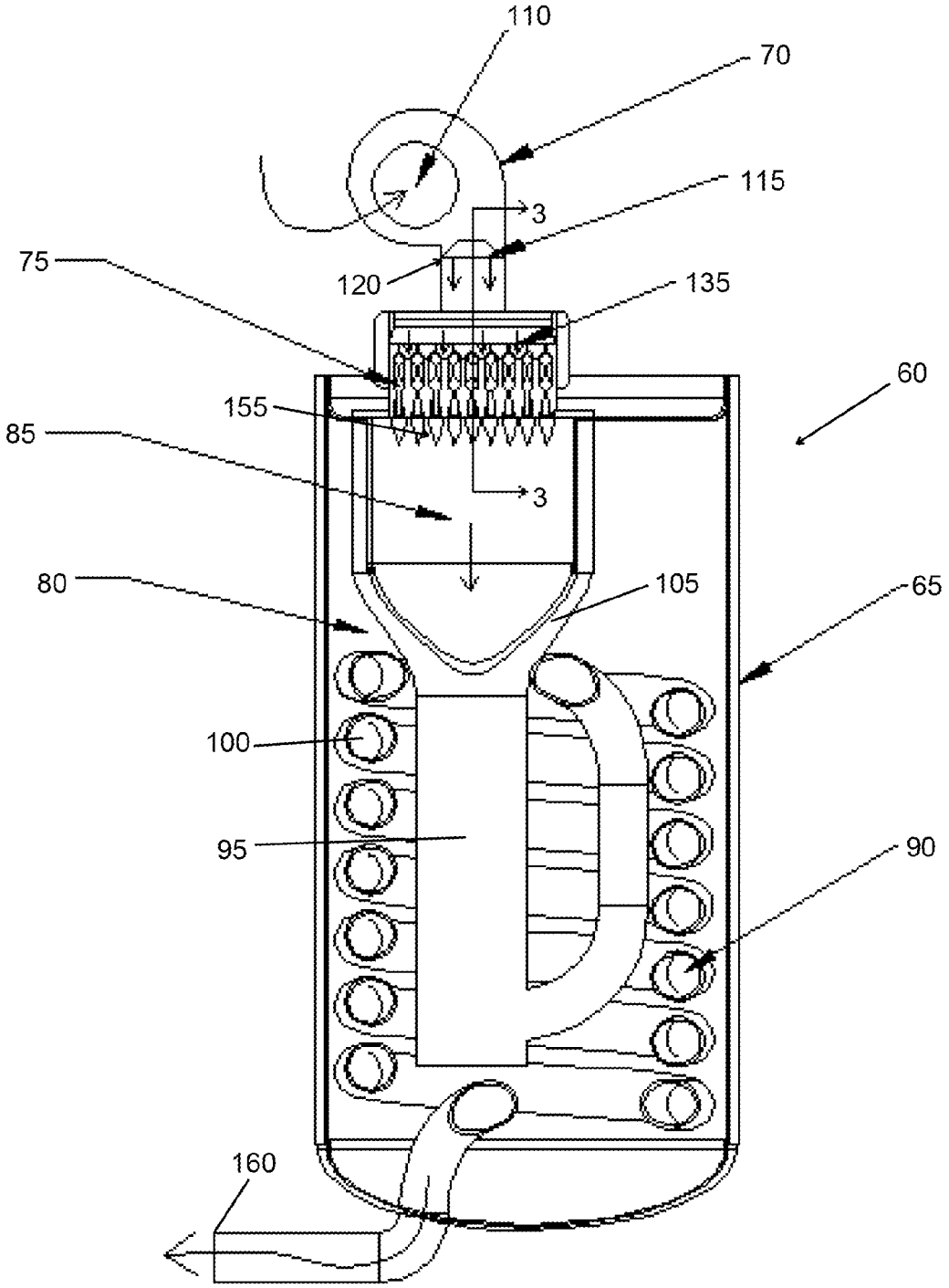
FIG. 2 is a front sectional view of a storage gas water heater.
Figure 3:
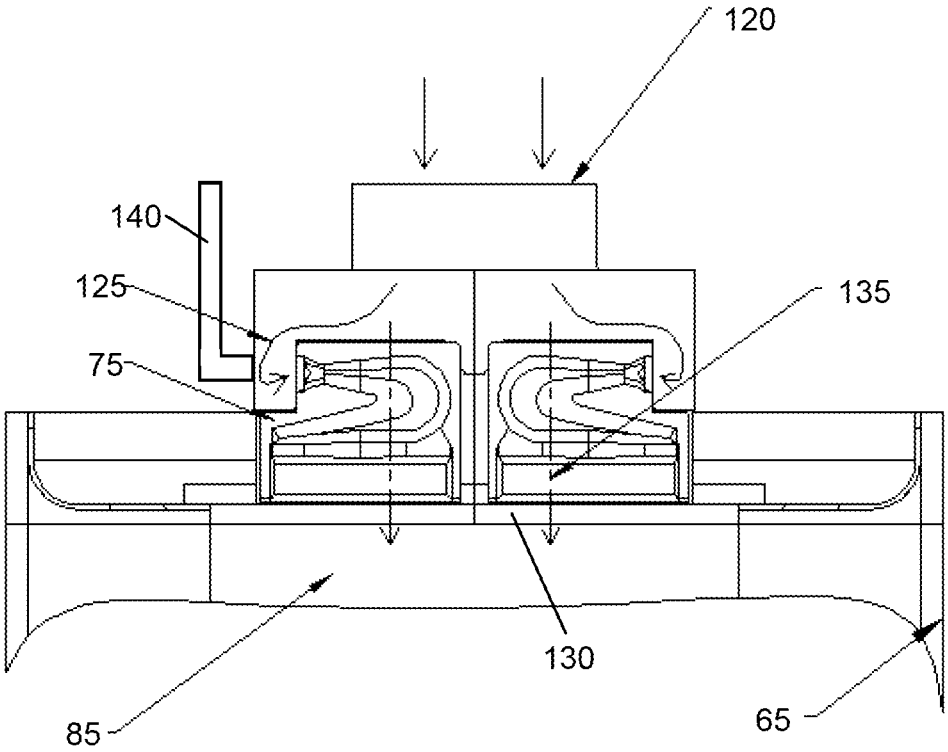
FIG. 3 is a sectional view of the storage gas water heater of FIG. 2 along line 3-3.
Figure 4:
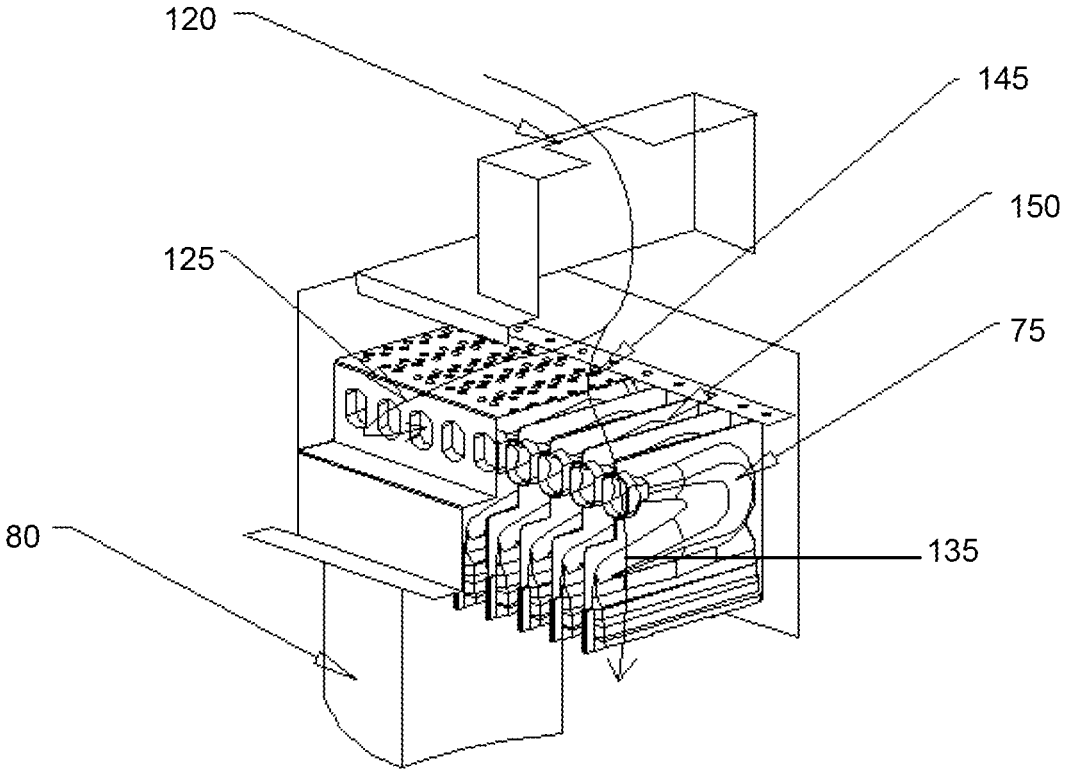
FIG. 4 is a perspective view of a portion of the storage gas water heater of FIG. 2.

FIGS. 2-4 illustrate a storage gas water heater 60 including a water tank 65, a fan 70, a burner 75, and a heat exchanger and combustion tube 80. The heat exchanger and combustion tube 80 is composed of a combustion chamber 85 and a heat exchanger tube 90. The burner 75 is composed of a set of harmonica-like burners. The heat exchanger tube 90 is composed of a central main tube 95 and a spiral tube 100 which is connected with and revolves around the main tube 95. The combustion chamber 85 is connected with the main tube by a reducer coupling 105.

The fan 70 includes an air inlet or fan inlet 110 and an outlet or fan outlet 115. The water heater 60 includes an air-supply opening 120. The air inlet 110 of fan 70 is open to (i.e., communicates with) the air outside the water heater 60, and the outlet 115 is connected with the air-supply opening 120. The air-supply opening 120 is connected with (i.e., communicates with) the burner 75 by a first air-supply channel 125 (FIG. 3), and at the same time the air-supply opening 120 is connected with (i.e., communicates with) a burner inlet 130 of the combustion chamber 85 by a second air-supply channel 135. The first air-supply channel 125 provides primary combustion air to the burner 75 for pre-mixture with fuel gas, and the second air-supply channel 135 provides secondary combustion air to the combustion chamber 85. A gas supply line or conduit 140 introduces fuel gas into the first air-supply channel 125 or burner 75. The primary air is evenly mixed with the fuel gas in the burner 75 to form the premix gas.

With reference to FIGS. 2 and 4, the second air-supply channel 135 starts from a secondary air distributing plate 145 between the air-supply opening 120 and the combustion chamber 85. The second air-supply channel 135 is further defined by and connected with the combustion chamber 85 through gaps 150 between the set of harmonica-like burners. As a result, a totally-sealed channel is defined from the air inlet 110 of the fan 70 to the heat exchanger and combustion tube 80. The heat exchanger and combustion tube 80 may be at least partially inside water tank 65, or totally submersed as illustrated. One end of the heat exchanger and combustion tube 80 is connected with an outlet 155 of the burner 75, and an outlet 160 of the heat exchanger and combustion tube 80 is open to (i.e., communicates with) air outside the water heater 60.

One advantage of this partial premix combustion system lies in that the combustion air needed for the combustion enters combustion chamber 85 as two parts, and the combustion mode is sealed combustion. The burning system has only one air-supply opening 120 and one outlet 160 of the heat exchanger and combustion tube 80. The mixed gas (i.e., the mixture of primary air and fuel gas) may in some embodiments be too rich for combustion (i.e., it is over the upper explosive limit), and does not become fully combustible until it enters the combustion chamber 85 and is further mixed with secondary air. In this regard, the system is designed to reduce the likelihood that a fully combustible mixture will be created outside of the combustion chamber 85.

Generally, if the concentration of the fuel gas in the air is lower than the lower explosive limit $L_{low}$, the heat produced by the oxidation reaction is not enough to make up the lost heat, so burning can't continue; and if the concentration is over the upper explosive limit $L_{high}$, burning also can't take place because of oxygen deficiency. Both of the explosive limits L are calculated as: $L=V_{gas}/(V_{air}+V_{gas})$. Where, $V_{gas}$ is the volume of the fuel gas and $V_{air}$ is the volume of the air.

To make combustion normally ongoing, the fuel gas concentration shall be ensured to between the upper explosive limit and the lower explosive limit. Because this invention adopted a structure to separate primary air and secondary air, it may make the fuel gas concentration in the burner higher than the upper explosive limit, namely the fuel gas concentration in the burner is higher than the fuel gas concentration in the combustion chamber. In the combustion chamber, due to the addition of the secondary air, the fuel gas concentration falls into the explosive limit. For example, the upper explosive limit of methane in the air at normal temperature and pressure is 15%, thus, the fuel gas concentration in the burner shall be more than 15% as for the stated water heater used methane as fuel gas.

In combustion, to completely burn out one cubic meter (1 $m^3$) of fuel gas, the required air volume calculated according to the reaction equation is called theoretical air requirement $V_o$, while in actual combustion apparatus, if air is supplied only according to the theoretical air requirement, it is very difficult to fully mix the fuel gas and air, so the oxygen in the air can't thoroughly take part in the reaction and makes the combustion inadequate. So the actual air supply is generally more than the theoretical air requirement. The ratio of actual air supply V to theoretical air requirement $V_o$ is defined as excess air ratio α, namely: $\alpha=V/V_o$. For hydrocarbon fuel $C_nH_n$, the relationship between the theoretical air requirement $V_o$ and the fuel quantity $V_{gas}$ participating in the action is: $V_o=n+0.25\ m/0.21V_{gas}$.

The excess air ratio α adopted by this invention is less than 1.3, which is at the same level with common existing premix combustion system. Study shows that this value may ensure high heat exchange efficiency of the system and low contaminant emission level, especially if the CO value is less than 50 PPM under rated load. Correspondingly, if the same combustion system is used in a tankless gas water heater, the CO value is generally higher than 100 PPM and the excess air ratio is more than 2.

Compared with a non-sealed partial premix combustion system, the advantage of the above-mentioned system lies in that the excess air ratio is lowered by 40% and the CO emission amount has also great reduction. Under the conditions of similar water tank volume, the input power of the above-mentioned system may reach 30 kw (102,433 BTU/hr), while the traditional non-sealed partial premix combustion system is only 20 kw (68,289 BTU/hr) in general. The higher input power improves the restoring time of the water heater and provides the possibility of large quantity of water supply. Or with the similar hot water supply capacity, it may reduce the water heater's volume and broaden the usable range of storage gas water heater. Compared with premix combustion system, the advantage of the above-mentioned system is cost reduction potentially over 50%.

The following table shows the comparison of a typical working parameter of the storage gas water heater 60 with an ordinary storage water heater, a tankless water heater, and a premix combustion system. The results show that the combustion efficiency of the storage gas water heater 60 may reach the level of the premix combustion system, and has great improvement compared with the ordinary tankless water heater and the ordinary storage water heater.

| | Rated Heat Load | Thermal Efficiency | Flue Gas Temperature ° C. | CO ppm | Excess air ratio |
|---|---|---|---|---|---|
| Storage Gas Water Heater | 26 | 107 | 37 | 61 | 1.46 |
| Ordinary Tankless | 26 | 88 | 150 | 260 | 2.35 |
| Premix System | 24 | 101 | 63 | 91 | 1.44 |
| Ordinary Storage Type | 20 | 80 | 150 | 200 | 1.7 |

Figure 8:
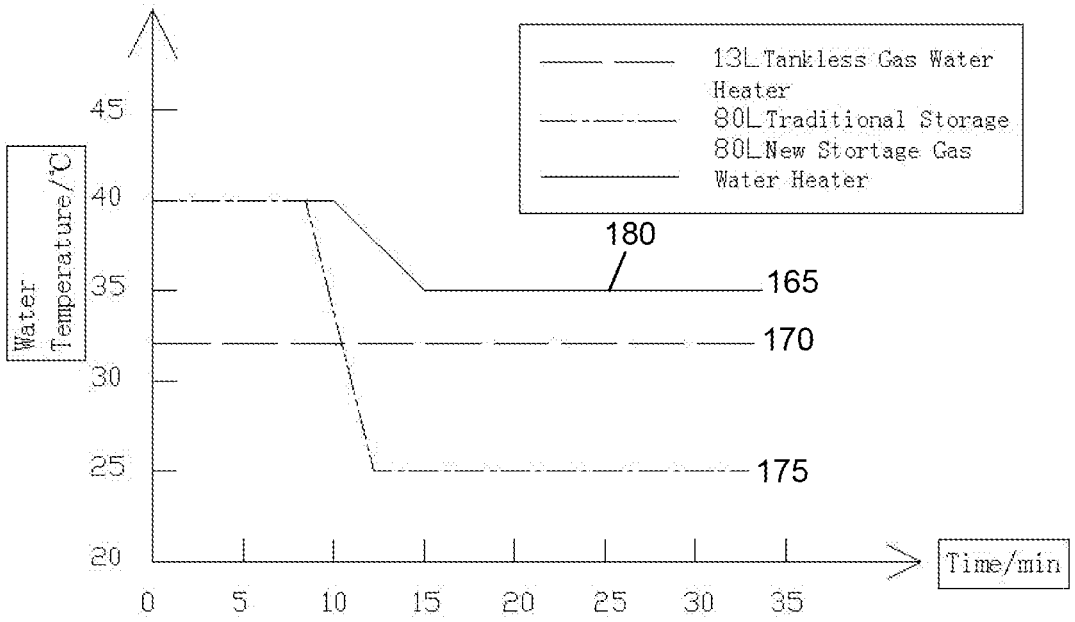
FIG. 8 is a graph comparing a storage gas water heater and similar existing products.

FIG. 8 displays a comparison of the hot water supply capacity between the storage gas water heater 60 (shown as line 165), a tankless water heater (shown as line 170), and a traditional storage water heater (shown as line 175). The storage gas water heater 60 has an input power of 26 kw (88,775 BTU/hr), a water supply quantity of 10 L/min (2.64 gal/min) and a volume of 80 L (21.13 gal.). The tankless water heater has an input power of 26 kw (88,775 BTU/hr) and a water supply quantity of 13 L/min (3.43 gal/min) at 25° C. (77° F.) temperature rise. The traditional storage water heater has an input power of 20 kw (68,289 BTU/hr) and volume of 80 L (21.13 gal.). Line 175 is the water supply curve of the traditional storage water heater, which can continuously supply hot water with 40° C. (104° F.) temperature rise at flow rate of 10 L/min (2.64 gal/min) for 8 minutes, and then supply hot water with 25° C. (77° F.) temperature rise constantly. The line 165 is the water supply curve of the storage gas water heater 60, which can supply water at flow rate of 10 L/min (2.64 gal/min) for 10 minutes and then continuously supply hot water of 36° C. (96.8° F.) temperature rise, namely like a tankless water heater. The line 170 is the water supply curve of the tankless water heater, which can only continuously supply hot water with 32.5° C. (90.5° F.) temperature rise. The height difference between a portion 180 of line 165 and line 170 is caused by the efficiency difference between the storage gas water heater 60 and the tankless water heater. As shown in FIG. 8, the storage gas water heater 60 has advantages over the traditional storage gas water heater with similar volume and the tankless water heater with similar input power. It combines the advantages of the traditional storage water heater's storage tank and the high power of the tankless water heater.

Figure 5:
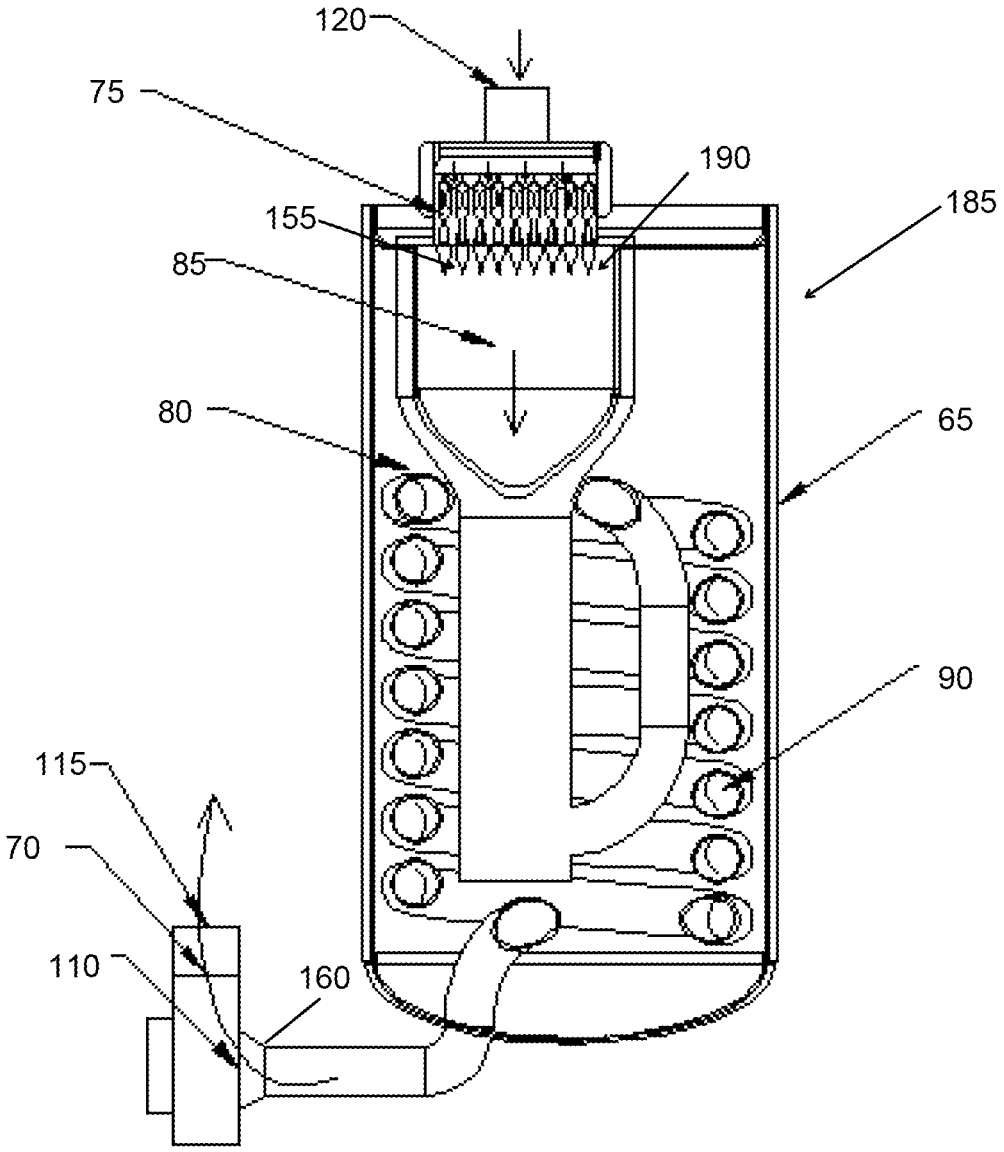
FIG. 5 is a front sectional view of a storage gas water heater.

FIG. 5 illustrates a storage gas water heater 185, whose basic structure is the same as the storage gas water heater 60 shown in FIGS. 2-4. The air-supply opening 120 is connected with burner 75 by the first air supply channel 125 and at the same time is connected with combustion chamber 85 by the second air supply channel 135. At least part of the heat exchanger and combustion tube 80 is inside the water tank 65, and a first end 190 of heat exchanger and combustion tube 80 is connected with the outlet 155 of the burner 75. The difference is that the outlet 160 of the heat exchanger and combustion tube 80 is connected with the air inlet 110 of fan 70, which composes of a totally-sealed channel from the air-supply opening 120 to the fan outlet 115 with the outlet 115 open to the air. Because the fan 70 is positioned after the heat exchanger and combustion tube 80, negative pressure is formed in the system while working, so air is drawn in through the air-supply opening 120 and the flue gas is discharged by the outlet 115 of the fan 70.

Figure 6:
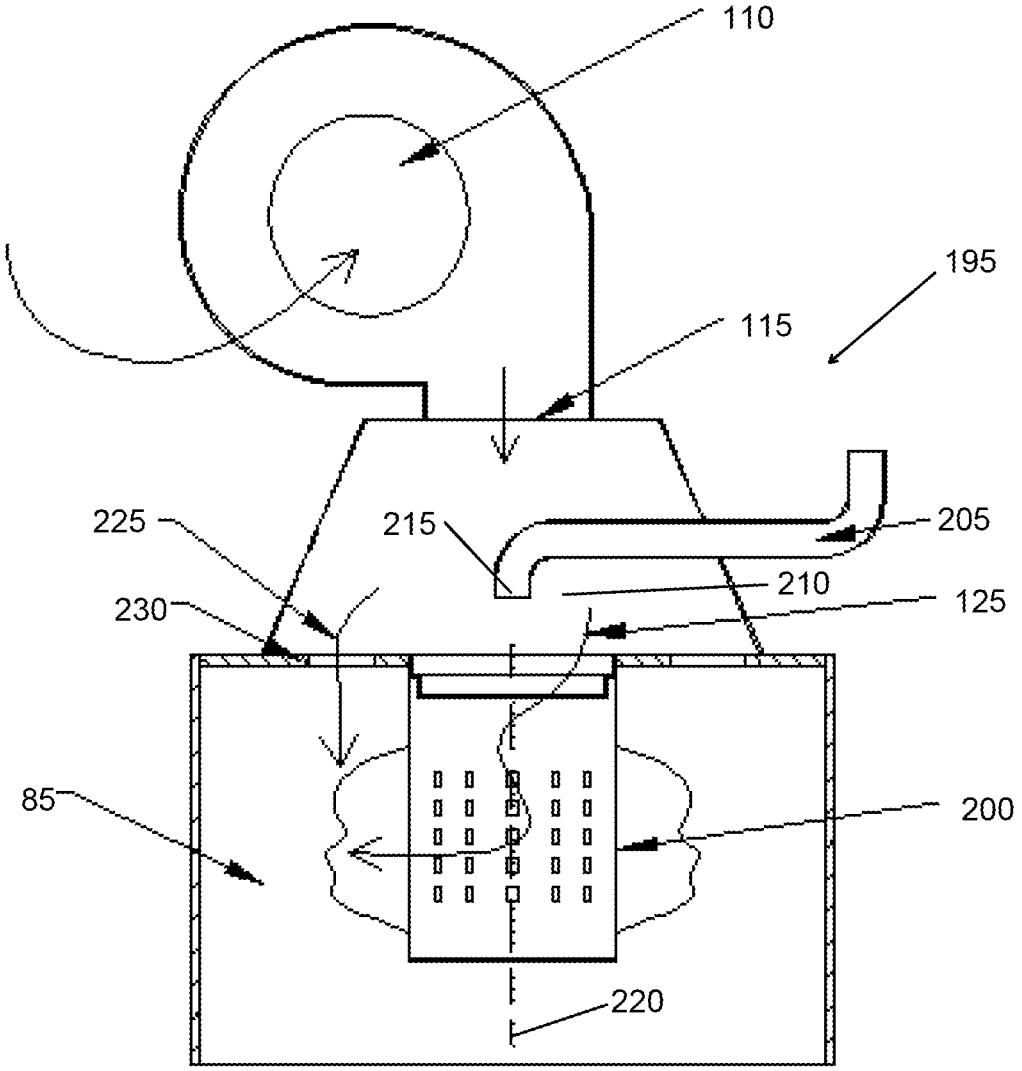
FIG. 6 is a front sectional view of a portion of a storage gas water heater.

FIG. 6 illustrates a portion of a storage gas water heater 195, whose basic structure is the same as the storage gas water heater 60 shown in FIGS. 2-4 except for the combustion system, so there is no need for a detailed explanation of the rest of the water heater 195. The combustion system includes a cylindrical burner 200. One advantage of the water heater 195 is that the structure of the burner 200 is simpler than the harmonica-like burner 75 of the storage gas water heater 60. The system needs only one burner 200 and the burner's length may be changed together with the load. If the load is increased, the length of the burner 200 and the combustion chamber 85 can also be increased. A gas line 205 is located at a front part 210 of the burner 200 and a gas line outlet 215 is positioned at a central line 220 of the burner 200. The gas is sprayed along the central line 220 of burner 200. The second air-supply channel 225 does not extend through gaps in the burner 200, but is instead defined only by the secondary air distributing plate 230.

Figure 7:
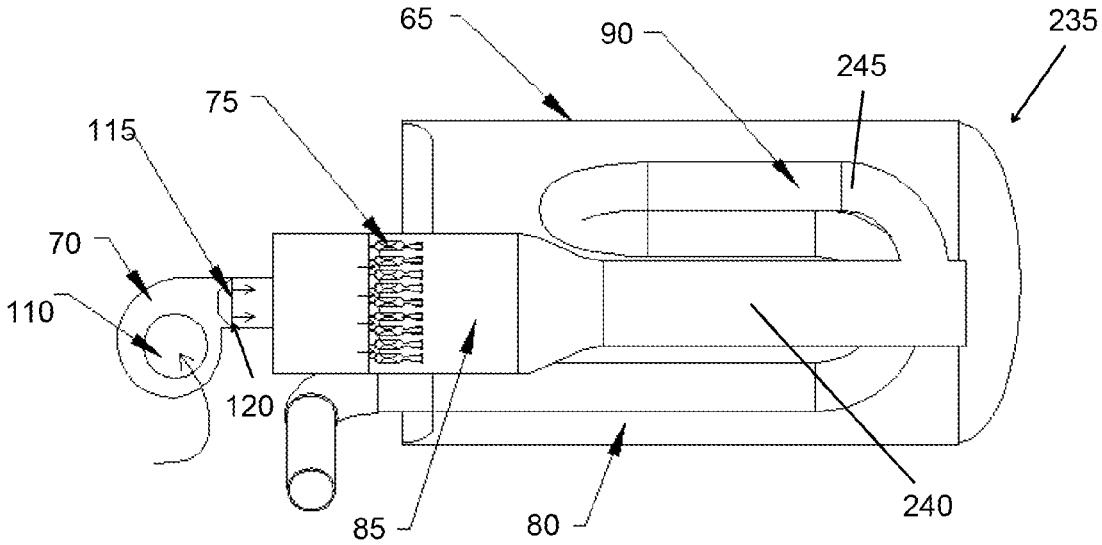
FIG. 7 is a front sectional view of a storage gas water heater.

FIG. 7 illustrates a storage gas water heater 235, whose basic structure is the same as the storage gas water heater 60 shown in FIGS. 2-4. The air inlet 110 of the fan 70 is open to the air and the outlet 115 is connected with the air-supply opening 120. The air-supply opening 120 is connected with the burner 75 by the first air-supply channel 125 and at the same time connected with the combustion chamber 85 by the second air-supply channel 135. The second air-supply channel 135 starts from the secondary air distributing plate 145 and is connected with the combustion chamber 85 through the gaps 150 between the burners 75. The heat exchanger and combustion tube 80 is positioned inside the water tank 65, and one end of it is connected with the outlet of the burner 75 and the other end is open to the air. The heat exchanger and combustion tube 80 is composed of horizontal combustion chamber 85 and the heat exchanger tube 90. The heat exchanger tube 90 is composed of a main tube 240 and a Z-shaped elbow 245 connected with the main tube 240. Because the water tank 65 is horizontal, the other components are also horizontal. One advantage of the storage gas water heater 235 is that the horizontal structure is suited to the available space in small living quarters and the water heater can be hung on the wall to save space.

Except for the above-mentioned embodiments, this invention may have other embodiments. Any technology adopting identical substitution or equivalent alteration also belongs to the protection domain claimed by this invention.

What is claimed is:

1. A storage gas water heater comprising a water tank, a fan, a partial premix burner and a heat exchanger and combustion tube, wherein:

an air inlet of the fan is open to air outside of the water heater and an outlet of the fan is connected with an air-supply opening;

the air-supply opening is connected with the partial premix burner by a first air-supply channel and is connected with a combustion chamber of the heat exchanger and combustion tube by a second air-supply channel;

the first and second air-supply channels together define a totally-sealed channel from the air inlet of the fan to the heat exchanger and combustion tube;

at least part of the heat exchanger and combustion tube is inside the water tank;

one end of the heat exchanger and combustion tube is connected with an outlet of the partial premix burner and an opposite end is open to air outside of the water heater;

an excess air ratio for combustion in the combustion chamber is less than 1.5;

the partial premix burner is composed of a plurality of harmonica-like burners and receives all primary and secondary air for combustion from the fan through the totally-sealed channel defined by the first and second air-supply channels; and the second air-supply channel connects a secondary air distributing plate, located between the air-supply opening and the combustion chamber, to the combustion chamber through at least one gap between the plurality of harmonica-like burners.

2. The gas water heater of claim 1, wherein the heat exchanger and combustion tube comprises the combustion chamber and a heat exchanger tube; wherein the partial premix burner is connected with heat exchanger tube by the combustion chamber; and wherein the heat exchanger tube is inside the water tank.

3. The gas water heater of claim 2, wherein the heat exchanger tube comprises a central main tube and a spiral tube which is connected with and revolves around the main tube; and wherein the combustion chamber is connected with the main tube by a reducer coupling.

4. The gas water heater of claim 2, wherein the heat exchanger tube comprises a central main tube and a Z-shaped elbow connected with the main tube.

5. The gas water heater according to claim 1, wherein the first air supply channel provides primary air to the partial premix burner for premixture with fuel gas introduced by a gas supply line, and the second air-supply channel provides secondary air to the combustion chamber, the primary air is evenly mixed with the fuel gas in the partial premix burner to form a primary air-fuel mixture.

6. The gas water heater according to claim 1, wherein primary air and fuel gas enter the combustion chamber only through the partial premix burner.

7. The gas water heater according to claim 2, wherein the combustion chamber is sealed except for communication with the partial premix burner, the second air-supply channel, and the heat exchanger tube.

8. The gas water heater according to claim 1, wherein the combustion chamber is adapted to receive a primary air-fuel mixture and secondary air, and adapted to contain the complete combustion of the primary air-fuel mixture in the presence of the secondary air for the creation of products of combustion.

9. The gas water heater according to claim 8, wherein the primary air-fuel mixture has a gas concentration above an upper explosive limit for the fuel gas.

10. The gas water heater according to claim 1, wherein there is no mixing of fuel gas and air in the fan.

11. The gas water heater according to claim 1, wherein the storage gas water heater utilizes partial premix combustion with an excess air ratio for combustion in the combustion chamber being less than 1.3.

12. The gas water heater according to claim 1, wherein the second air-supply channel connects the secondary air distributing plate, located between the air-supply opening and the combustion chamber, to the combustion chamber through multiple gaps between the plurality of harmonica-like burners.

* * * * *